US010176743B2

(12) United States Patent
Wang

(10) Patent No.: US 10,176,743 B2
(45) Date of Patent: Jan. 8, 2019

(54) METHOD FOR ADJUSTING COLOR TEMPERATURE AND DEVICE

(71) Applicants: HISENSE CO., LTD., South area of Qingdao (CN); HISENSE USA CORP., Suwanee, GA (US); HISENSE INTERNATIONAL CO., LTD., Shandong (CN)

(72) Inventor: Zhen Wang, South area of Qingdao (CN)

(73) Assignees: HISENSE CO., LTD., South Area of Qingdao (CN); HISENSE USA CORPORATION, Suwanee, GA (US); HISENSE INTERNATIONAL CO., LTD., Shandong (CN)

( * ) Notice: Subject to any disclaimer, the term of this patent is extended or adjusted under 35 U.S.C. 154(b) by 18 days.

(21) Appl. No.: 15/186,847

(22) Filed: Jun. 20, 2016

(65) Prior Publication Data

US 2016/0372021 A1 Dec. 22, 2016

(30) Foreign Application Priority Data

Jun. 18, 2015 (CN) ..... 2015 1 0341586

(51) Int. Cl.

*G09G 3/20* (2006.01)
*G09G 5/10* (2006.01)
*G09G 3/00* (2006.01)

(52) U.S. Cl.

CPC ..... *G09G 3/2003* (2013.01); *G09G 3/002* (2013.01); *G09G 3/20* (2013.01); *G09G 5/10* (2013.01);

(Continued)

(58) Field of Classification Search

CPC ..... G09G 3/2003; G09G 3/002; G09G 3/20; G09G 3/3406; G09G 5/10;

(Continued)

(56) References Cited

U.S. PATENT DOCUMENTS 7,888,888 B2 * 2/2011 Huang ..... H05B 33/0818 315/291
2002/0003522 A1 * 1/2002 Baba ..... G09G 3/342 345/89

(Continued)

FOREIGN PATENT DOCUMENTS

CN 1598918 A 3/2005
CN 1781135 A 5/2006

(Continued)

OTHER PUBLICATIONS

Office Action issued in corresponding Chinese Patent Application No. 201510341586.2, dated Dec. 5, 2016.

(Continued)

*Primary Examiner* — Tom Sheng
(74) *Attorney, Agent, or Firm* — McDermott Will & Emery LLP

(57) ABSTRACT

Embodiments of the present disclosure disclose a method for adjusting color temperature and a device. The method comprises: acquiring a present light intensity parameter value of each of N primary colors of light emitted by a light source of a display device, determining a set light intensity parameter value of each of the N primary colors according to the present light intensity parameter value of each of the N primary colors and a pre-saved light intensity parameter value of each of the N primary colors, and respectively adjusting the light intensity of each of the N primary colors according to the set light intensity parameter value of the N primary colors.

16 Claims, 2 Drawing Sheets

(52) U.S. Cl.
CPC ..... *G09G 2320/0233* (2013.01); *G09G 2320/062* (2013.01); *G09G 2320/0666* (2013.01); *G09G 2360/14* (2013.01); *G09G 2360/145* (2013.01)

(58) Field of Classification Search
CPC ..... G09G 2320/0233; G09G 2320/062; G09G 2320/0626; G09G 2320/0633; G09G 2320/064; G09G 2320/0646; G09G 2320/0666; G09G 2360/14; G09G 2360/145
See application file for complete search history.

(56) References Cited

U.S. PATENT DOCUMENTS

2003/0146919 A1* 8/2003 Kawashima ..... G09G 3/3406 345/609
2006/0092182 A1* 5/2006 Diefenbaugh ..... G06F 1/3218 345/690
2006/0127081 A1* 6/2006 Lee ..... G09G 3/3406 396/282
2006/0227085 A1 10/2006 Boldt et al.
2007/0046826 A1 3/2007 Bellis et al.
2008/0024528 A1* 1/2008 Han ..... G02B 26/0808 345/690
2008/0225520 A1* 9/2008 Garbus ..... G01J 3/46 362/231
2009/0015172 A1* 1/2009 Huang ..... H05B 33/0818 315/246
2011/0095965 A1* 4/2011 Yoneoka ..... G06F 3/1446 345/1.1
2012/0038694 A1* 2/2012 Nakanishi ..... G09G 3/3426 345/694
2012/0098851 A1* 4/2012 Yamaguchi ..... G03B 21/14 345/589
2012/0242633 A1* 9/2012 Kim ..... G09G 3/20 345/207
2013/0328841 A1* 12/2013 Syed ..... G01J 1/0271 345/207
2014/0191681 A1* 7/2014 Noller ..... H03K 3/00 315/224
2014/0198137 A1* 7/2014 Feng ..... G09G 3/3406 345/690
2016/0372021 A1* 12/2016 Wang ..... G09G 3/2003

FOREIGN PATENT DOCUMENTS

CN 101364380 2/2009
CN 101635140 A 1/2010
CN 102105001 A 6/2011
CN 201878396 U 6/2011
CN 102679191 A 9/2012

OTHER PUBLICATIONS

Office Action issued in corresponding Chinese Patent Application No. 201510341586.2, dated Aug. 18, 2017.
Office Action issued in corresponding Chinese Patent Application No. 201510341586.2, dated Jan. 19, 2018.

* cited by examiner

METHOD FOR ADJUSTING COLOR TEMPERATURE AND DEVICE

CROSS-REFERENCE TO RELATED APPLICATIONS

The application claims the benefit and priority of Chinese Patent Application 201510341586.2, filed on Jun. 18, 2015 and titled "METHOD FOR ADJUSTING COLOR TEMPERATURE AND DEVICE", the disclosure of which is incorporated herein by reference in its entirety.

FIELD OF TECHNOLOGY

The present disclosure relates to the optical field and in particular to a method for adjusting color temperature and device.

BACKGROUND

At present, with the development of the optical technology, display devices are increasingly updated and developed. Most of light sources in display devices are light emitting diodes (LEDs) and laser sources. Laser sources have been widely applied to various apparatus, for example, laser projection displays or the like, due to their good monochromaticity, good directivity and high brightness.

However, in display devices, because of long-term impact from dust, temperature and other factors, the light sources, particularly laser sources, will have attenuation, leading to an offset in the color temperature of images and thus an offset in the white balance, and resulting in too bright displayed pictures or color derivation. Consequently, the quality of display of products is deteriorated.

SUMMARY OF THE DISCLOSURE

In one aspect, an embodiment of the present disclosure provides a method for adjusting color temperature, including:

acquiring, by an acquisition unit, a present light intensity parameter value of each of N primary colors of light emitted by a light source of a display device, a present light intensity parameter value of a $n^{th}$ primary color of the N primary colors being indicative of the present light intensity of the $n^{th}$ primary color of light emitted by the light source of the display device, N being an integer greater than or equal to 3, n being an integer within [1, N];

determining, by a processor, a set light intensity parameter value of each of the N primary colors, according to the present light intensity parameter value of each of the N primary colors determined by the acquisition unit and a pre-saved light intensity parameter value of each of the N primary colors; and respectively adjusting, by an adjustment unit, the light intensity of each of the N primary colors according to the set light intensity parameter value of the N primary colors.

In another aspect, an embodiment of the present disclosure provides a display device, including:

an acquisition unit, configured to acquire a present light intensity parameter value of each of N primary colors of light emitted by a light source of a display device, a present light intensity parameter value of a $n^{th}$ primary color of the N primary colors being indicative of the present light intensity of the $n^{th}$ primary color of light emitted by the light source of the display device, N being an integer greater than or equal to 3, n being an integer within [1, N];

a memory, configured to store programs;

a processor, configured to read the programs in the memory, and execute the step of determining a set light intensity parameter value of each of the N primary colors, according to the present light intensity parameter value of each of the N primary colors acquired by the acquisition unit and a pre-saved light intensity parameter value of each of the N primary colors; and an adjustment unit, configured to respectively adjust the light intensity of each of the N primary colors according to the set light intensity parameter value of the N primary colors obtained by the processor.

BRIEF DESCRIPTION OF THE DRAWINGS

To describe the technical solutions of the embodiments of the present disclosure more clearly, drawings to be used for the description of the embodiments or the prior art will be briefly introduced below. Apparently, the drawings to be described below are merely some embodiments of the present disclosure. Other drawings may be obtained by a person of ordinary skill in the art according to those drawings without paying any creative effort.

DETAILED DESCRIPTION OF THE PREFERRED EMBODIMENTS

The technical solutions in the embodiments of the present disclosure will be described clearly and completely below with reference to the drawings in the embodiments of the present disclosure. Obviously, the described embodiments are merely some but not all of the embodiments of the present disclosure. All other embodiments obtained by a person of ordinary skill in the art on the basis of the embodiments of the present disclosure without paying any creative effort are included within the protection scope of the present disclosure.

One embodiment of the present disclosure provides a method for adjusting color temperature, which is applied to a display device. Preferably, the display device can be a laser projector.

Figure 1:
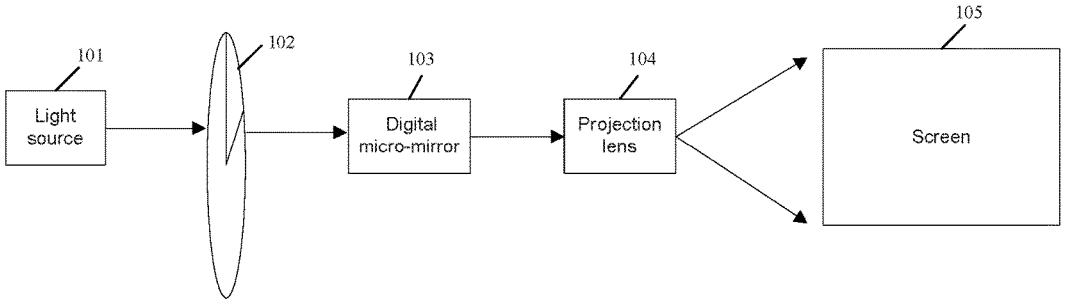
FIG. 1 is a structure diagram of a laser projector according to one embodiment of the present disclosure.

For example, as shown in FIG. 1, the laser projector may include a light source 101, a fluorescent wheel 102, a filter wheel (not shown), a digital micro-mirror device 103, a projection lens 104, a screen 105 and the like. Wherein, the light source 101 is configured to emit light. For example, the light source can be a monochromatic blue laser. The fluorescent wheel 102 is configured to project light of a desired color onto the digital micro-mirror device 103. Specifically, the fluorescent wheel 102 is generally formed of several areas, for example, formed of a blue light transmitting area, a green fluorescent area and a red fluorescent area, and fluorescent wheel 102 rotates at a certain speed. In this way, at every moment, light of only one color is output from the fluorescent wheel 102. For example, at the beginning of one timing unit period, blue laser light emitted by the light source is emergent from the blue light transmitting area of the fluorescent wheel 102, and the blue light is output through a blue filter; when the fluorescent wheel 102 rotates so that blue laser light is incident onto the green fluorescent area, green light is excited and output through a green filter; and similarly, when the fluorescent wheel 102 rotates so that blue laser light is incident onto the red fluorescent area, red light is excited and output through a red filter. The digital micro-mirror device 103 is configured to cause light to form a picture to be projected, and the picture is then projected onto the screen 105 by the projection lens 104. In this way, the whole display process of the laser projector is completed.

Because of long-term impact from dust, temperature and other factors, the laser source will have attenuation and the fluorescence efficiency of the fluorescent wheel will decrease, leading to an offset in the color temperature of the generated images and thus partial color in the displayed pictures if the red, green and blue primary colors output by the filter wheels have a different attenuation degree.

The method for adjusting color temperature according the embodiments of the present disclosure effectively solves or alleviates the problem of causing an offset in the color temperature by inconsistent light attenuation of the primary colors in the prior art. Specifically, referring to FIG. 2, the method for adjusting color temperature includes the following steps.

S201: By an acquisition unit, a present light intensity parameter value of each of N primary colors of light emitted by a light source of a display device is acquired.

A present light intensity parameter value of a $n^{th}$ primary color of the N primary colors is indicative of the present light intensity of the $n^{th}$ primary color of light emitted by the light source of the display device, actually the light intensity of light presently emitted by the $n^{th}$ primary color when driven by the present current and/or voltage. N is an integer greater than or equal to 3, and n is an integer within [1, N].

Optionally, the light intensity parameter of the N primary colors may be acquired by a light sensor which is mounted in a light emitting path of the light source of the display device.

It is to be noted that, in the embodiments of the present disclosure, the N primary colors may be emitted directly by the light source, and also may be output after light emitted by the light source is converted. For example, when the display device is a laser projector, the N primary colors are formed after light emitted by the light source is passed through the fluorescent wheel and/or filter wheel. For another example, when the display device is a liquid crystal display, the N primary colors are formed after light emitted by the light source is passed through a color filter.

S202: By a processor, a set light intensity parameter value of each of the N primary colors is determined, according to the present light intensity parameter value of each of the N primary colors and a pre-saved light intensity parameter value of each of the N primary colors.

Wherein, a pre-saved light intensity parameter value of a $n^{th}$ primary color of the N primary colors is indicative of the pre-saved light intensity of the $n^{th}$ primary color of the N primary colors of the display device. For example, when the display device is a laser projector and the N primary colors are respectively red, green and blue, when the laser projector leaves the factory, at the pre-saved PWM current, the light intensity of blue light emitted by a blue laser source of the laser projector is the pre-saved light intensity of blue light, the light intensity of green light excited when the blue laser light is irradiated onto the green fluorescent area is the pre-saved light intensity of green light, and the light intensity of red light excited when the blue laser light is irradiated onto the red fluorescent area is the pre-saved light intensity of red light.

Optionally, generally, when the display device leaves the factory, the pre-saved light intensity parameter values of the N primary colors are the maximum light intensity the N primary colors can actually achieve. Of course, this is provided as an example, and the present disclosure is not limited thereto. For example, when the pre-saved PWM current value of the laser projector is the maximum PWM current value the laser can withstand, at this pre-saved PWM current value, the pre-saved light intensity parameter value of blue light emitted by the blue laser source is the maximum light intensity the blue light can actually achieve. However, if the pre-saved PWM current value is not the maximum PWM current value the laser can withstand, that is, the laser can actually withstand a current greater than the pre-saved PWM current value, at this pre-saved PWM current value, the pre-saved light intensity parameter value of blue light emitted by the blue laser source is not the maximum light intensity the blue light can actually achieve, and in this case, if the PWM current value is adjusted to be greater than the pre-saved PWM current value, the light intensity of blue light can be increased.

Optionally, regardless of whether or not the pre-saved light intensity parameter values of the N primary colors are the maximum light intensity the N primary colors can actually achieve when the display device leaves the factory, the step S202 can specifically include: by the acquisition unit, determining a standard ratio according to the present light intensity parameter value of each of the N primary colors and the pre-saved light intensity parameter value of each of the N primary colors, the standard ratio being indicative of an adjustment degree of the N primary colors; and calculating the set light intensity parameter value of the $n^{th}$ primary color of the N primary colors by a first formula $X_{nd}=X_{np}\times U$, where $X_{nd}$ is the set light intensity parameter value of the $n^{th}$ primary color, $X_{np}$ is the pre-saved light intensity parameter value of the $n^{th}$ primary color, and U is the standard ratio. In this way, because the N primary colors have a same standard ratio, that is, the N primary colors have a same adjustment degree, the problem of causing an offset in the color temperature by inconsistent light attenuation of the primary colors in the prior art can be effectively solved or alleviated by calculating the set light intensity parameter values according to the standard ratio and then adjusting the primary colors according to those set light intensity parameter values. Correspondingly, the color temperature of images displayed by the display device is maintained relatively balanced.

Further optionally, in one embodiment of the present disclosure, the way of determining the standard ratio U specifically can be: by the processor, determining an attenuation degree of the $n^{th}$ primary color of the N primary colors according to a second formula $X'_n=(X_n-X_{nc})/X_{np}$, where $X_{np}$ is the pre-saved light intensity parameter value of the $n^{th}$ primary color, $X_{nc}$ is the present light intensity parameter value of the $n^{th}$ primary color, and $X'_n$ is the attenuation degree of the $n^{th}$ primary color; and determining the standard ratio U within an interval $[X_{n1c}/X_{n1p}, X_{n2c}/X_{n2p}]$, where $X_{n1c}$ is a present light intensity parameter value of a primary color having a minimum attenuation degree, $X_{n1p}$ is a pre-saved light intensity parameter value of a primary color having a minimum attenuation degree, $X_{n2c}$ is a present light intensity parameter value of a primary color having a maximum attenuation degree, and $X_{n2p}$ is a pre-saved light intensity parameter value of a primary color having a maximum attenuation degree.

Preferably, if an $i^{th}$ primary color of the N primary colors has the maximum attenuation degree, the processor uses a present light intensity parameter value of the $i^{th}$ primary color as a standard light intensity parameter value of the $i^{th}$ primary color, i being an integer within [1, N]; and calculates the standard ratio U by a third formula $U=X_{id}/X_{ip}$, where $X_{id}$ is the standard light intensity parameter value of the $i^{th}$ primary color and actually is the set light intensity parameter value of the $i^{th}$ primary color since the standard ratio U is determinate based on the $i^{th}$ primary color, and $X_{ip}$ is the pre-saved light intensity parameter value of the $i^{th}$ primary color.

It is to be noted that, among the N primary colors, some primary colors have a large attenuation degree while some primary colors have a small attenuation degree. As described in the above preferred implementation, a primary color having the maximum attenuation degree is used as the standard primary color, and a ratio of the present light intensity parameter value to the pre-saved light intensity parameter value of the primary color having the maximum attenuation degree is used as the standard ratio. Of course, not using a primary color having the maximum attenuation degree as the standard primary color is possible.

For example, one of a ratio between a ratio of the present light intensity parameter value to the pre-saved light intensity parameter value of a primary color having the maximum attenuation degree and a ratio of the present light intensity parameter value to the pre-saved light intensity parameter value of a primary color having the minimum attenuation degree may be determined as the standard ratio, to adjust the primary colors by taking the standard ratio as the adjustment degree of the primary colors. In this way, among the set light intensity parameter values of the primary colors determined according to the standard ratio, the present light intensity parameter value of a certain primary color may be greater than its set light intensity parameter value, while the present light intensity parameter value of a certain primary color may be less than its set light intensity parameter value.

If the pre-saved light intensity parameter values of the primary colors have already been the maximum light intensity those primary colors can actually achieve when the display device leaves the factory, for a primary color having a present light intensity parameter value greater than its set light intensity parameter value, in the subsequent step S203, the light intensity of the primary color may be reduced to the set light intensity parameter value according to the set light intensity parameter value of the primary color; and for a primary color having a present light intensity parameter value less than its set light intensity parameter value, in the subsequent step S203 of adjusting the light intensity according to the set light intensity parameter value of the primary color, the present light intensity parameter value of the primary color is maintained. In this way, in comparison with that before the adjustment, to some extent, the offset in the color temperature is reduced since the light intensity parameter of some primary colors is adjusted (actually, the light intensity of some primary colors is reduced).

If the pre-saved light intensity parameter values of the primary colors are not the maximum light intensity those primary colors can actually achieve when the display device leaves the factory, that is, the maximum light intensity those primary colors can actually achieve is greater than their pre-saved light intensity parameter values of the N primary colors, for a primary color having a present light intensity parameter value greater than its set light intensity parameter value, in the subsequent step S203, the light intensity of the primary color may be reduced, for example, the light intensity of the primary color is reduced to the set light intensity parameter value of the primary color; and for a primary color having a present light intensity parameter value less than its set light intensity parameter value, in the subsequent step S203, the present light intensity parameter value of the primary color may be increased. In the display device, for example, in a laser projector, a driving signal (for example, PWM current) which drives a certain primary color to emit light generally corresponds to the light intensity of the primary color. Accordingly, when the present light intensity parameter value of a certain primary color is less than the set light intensity parameter value of the primary color, the light intensity of the primary color may be increased by increasing the driving signal of the primary color. It is to be noted that, in order to ensure the normal use of the display device, the increased driving signal cannot exceed the maximum driving signal the display device can actually withstand. Hence, preferably, for a primary color having a present light intensity parameter value less than its set light intensity parameter value, in the subsequent step S203, increasing the light intensity of the primary color specifically can be: by the adjustment unit, increasing the light intensity of the primary color to the set light intensity parameter value of the primary color if a driving signal which drives the primary color to reach the maximum light intensity the primary color can actually achieve is greater than a driving signal which drives the primary color to reach the set light intensity parameter value thereof, and increasing the light intensity of the primary color to the maximum light intensity the primary color can actually achieve if a driving signal which drives the primary color to reach the maximum light intensity the primary color can actually achieve is less than a driving signal which drives the primary color to reach the set light intensity parameter value thereof. In this way, in comparison with that before the adjustment, the color temperature of the primary colors is maintained relatively balanced by reducing the light intensity of some primary colors and compensating for the light intensity of other primary colors, so that the offset in the color temperature is reduced.

In a further embodiment of the present disclosure, if the pre-saved light intensity parameter value of each of the N primary colors is not the maximum light intensity the primary color can actually achieve when the display device leaves the factory, that is, the pre-saved light intensity parameter value of each primary color is less than the maximum light intensity the primary color can actually achieve, the step S202 specifically can be: by the processor, determining the pre-saved light intensity parameter value of each of the N primary colors as the set light intensity parameter value of each of the N primary colors. In this way, in the subsequent step S203, the light intensity of each of the N primary colors may be respectively increased by a certain percentage of the pre-saved light intensity parameter value of the primary color. For example, the light intensity of each of the N primary colors may be respectively increased by Y % of the pre-saved light intensity parameter value of the primary color, wherein Y % of the pre-saved light intensity parameter value of each of the N primary colors is greater than the present light intensity parameter value of each of the N primary colors, optionally $Y>0$, preferably $50\leq Y\leq 100$, and further preferably $80\leq Y\leq 100$.

When the display device leaves the factory, the N primary colors each have the respective pre-saved light intensity parameter values, and each primary color takes up a certain percentage in the total light source. After a period of time of use, the N primary colors will have attenuation in different degrees, and the percentage of each primary color in the total light source changes, leading to an offset in the color temperature. In the embodiments of the present disclosure, the color temperature of the attenuated displayed images is maintained relatively balanced with respect to the color temperature of the displayed images when the display device leaves the factory, by determining a set light intensity parameter value of each primary color, and then respectively adjusting the light intensity of each primary color to the set light intensity parameter value of the primary color or to a certain percentage of the light intensity parameter value of the primary color or maintaining the present light intensity parameter value of the primary color so that the percentage of each attenuated primary color in the total light source is approximate to or equal to the percentage of each primary color in the total light source when the display device leaves the factory.

S203: By an adjustment unit, the light intensity of each of the N primary colors is respectively adjusted according to the set light intensity parameter value of the N primary colors.

Specifically, the light intensity of each of the N primary colors may be adjusted by adjusting their driving current or driving voltage.

For example, optionally, the PWM value of each of the N primary color may be respectively adjusted according to the set light intensity parameter value of the N primary colors. The PWM value of the $n^{th}$ primary color of the N primary colors is indicative of the magnitude of current controlling the light intensity of the $n^{th}$ primary color.

Further optionally, a variation $\Delta P_n$ in the PWM value of the $n^{th}$ primary color of the N primary colors is calculated by a fourth formula $\Delta P_n=(X_{np}-X_{nd})/K_m$, where $X_{nd}$ is the set light intensity parameter value of the $n^{th}$ primary color, $X_{np}$ is the pre-saved light intensity parameter value of the $n^{th}$ primary color, and $K_m$ is an adjustment coefficient which is indicative of a variation in the light intensity parameter of the $n^{th}$ primary color when the PWM value of the $n^{th}$ primary color is increased by 1.

It is to be noted that, if the pre-saved light intensity parameter values of the primary colors have already been the maximum light intensity those primary colors can actually achieve when the display device leaves the factory, as described above, the display device may reduce the light intensity of the N primary colors in a unified standard, or reduce the light intensity of some of the N primary colors in a unified standard while maintaining the present light intensity parameter value of the other primary colors to ensure the relative balance of the color temperature of images displayed by the display device; and if the pre-saved light intensity parameter values of the primary colors are not the maximum light intensity those primary colors can actually achieve when the display device leaves the factory, in the embodiments of the present disclosure, the light intensity of the N primary colors may be reduced in a unified standard, or the light intensity of some of the N primary colors may be reduced in a unified standard while increasing the light intensity of the other primary colors, or the light intensity of all the N primary colors may be increased. In this way, compared with the way of reducing the light intensity of the N primary colors in a unified standard, to some extents, the way of reducing the light intensity of some of the N primary colors in a unified standard while increasing the light intensity of the other primary colors or the way of increasing the light intensity of all the N primary colors increases the brightness of the light source of the display device, in order to achieve the relative balance of the color temperature while ensuring the brightness of images.

For example, if the pre-saved light intensity parameter values of the primary colors are not the maximum light intensity those primary colors can actually achieve when the display device leaves the factory, the attenuation degree of each primary color with respect to its pre-saved light intensity parameter value is measured. Since the pre-saved light intensity parameter values of the primary colors are not the maximum light intensity those primary colors can actually achieve, that is, the primary colors actually have maximum light intensity higher than the pre-saved light intensity parameter values, when the primary colors are adjusted according to the set light intensity parameter values of the primary colors, for a primary color having a large attenuation degree, the light intensity parameter of the primary color may be increased, for example, for a primary color having a set light intensity parameter value less than its present light intensity parameter value, the light intensity of the primary color may be adjusted according to the standard ratio to compensate to the set light intensity parameter value, while for a primary color having a small attenuation degree, the light intensity parameter of the primary color may be reduced, for example, for a primary color having a set light intensity parameter value greater than its present light intensity parameter value, the light intensity of the primary color may be reduced to the set light intensity parameter value according to the standard ratio; or, the light intensity of each of the primary colors may be increased to a certain percentage of the pre-saved light intensity parameter value of the primary color, so that the primary colors are maintained in balanced color temperature.

Thus, regardless of whether or not the pre-saved light intensity parameter values in the display device are the maximum light intensity the primary colors can actually achieve, the primary colors may be adjusted in a unified standard, to reduce or compensate for their brightness, so that the primary colors are maintained in relative balanced color temperature.

Of course, there are other modified adjustment ways, all of which are based on the principle of color temperature adjustment provided by the present disclosure and will not be enumerated here.

By the method for adjusting color temperature provided by the embodiments of the present disclosure, a present light intensity parameter value of each of N primary colors of light emitted by a light source of a display device is acquired, a set light intensity parameter value of each of the N primary colors is determined according to the present light intensity parameter value of each of the N primary colors and a pre-saved light intensity parameter value of each of the N primary colors, and the light intensity of each of the N primary colors is adjusted according to the set light intensity parameter value of the N primary colors. In this way, the set light intensity parameter value of each primary color is determined and adjusted, respectively, so that the light intensity of the primary colors is relatively balanced, and the offset in the color temperature is reduced. Accordingly, the deteriorated quality of display of the display device in the prior art, which is because of causing an offset in the color temperature by inconsistent light attenuation of the primary colors, is solved or alleviated.

Figure 2:
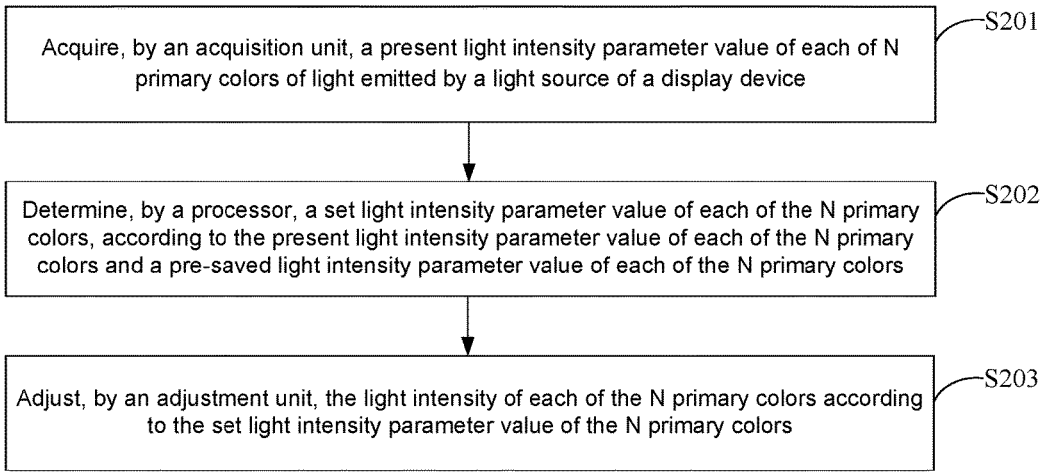
FIG. 2 is a schematic flowchart of a method for adjusting color temperature according to one embodiment of the present disclosure.
Figure 3:
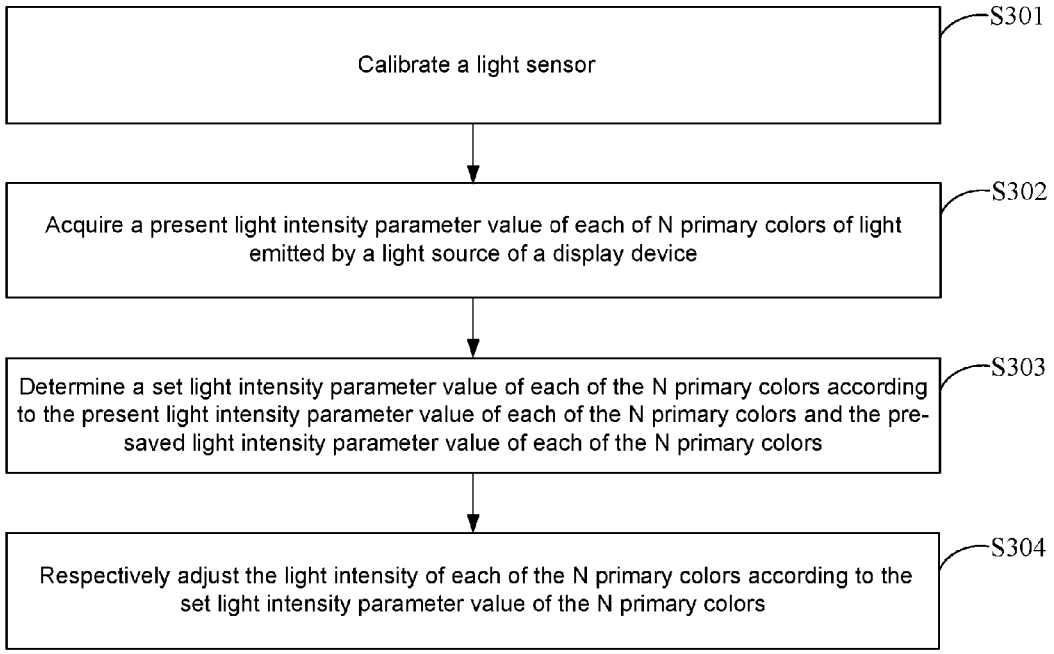
FIG. 3 is a schematic flowchart of a method for adjusting color temperature according to another embodiment of the present disclosure.

Based on the embodiment corresponding to FIG. 2, another embodiment of the present disclosure provides a method for adjusting color temperature. In this embodiment, the description will be given by taking (N=4) four primary colors, i.e., red, green, blue and yellow, as an example. Of course, this is provided as an example, and the present disclosure is not limited thereto. Specifically, this method can be applied to a laser projector. Referring to FIG. 3, this method includes the following steps.

S301: A light sensor is calibrated.

The PWM values of the N primary colors are adjusted to the maximum from the minimum according to a preset step size, and meanwhile, a light intensity parameter corresponding to each adjusted PWM value of the N primary colors is recorded. If the light intensity parameters corresponding to any two PWM values of any one of the N primary colors are the same, it is shown that the light sensor is not mounted properly and needs to be adjusted again until the light intensity parameters corresponding to any two PWM values of any one of the N primary colors are different.

Optionally, during the display of the display device, the display effect is somewhat influenced by ambient light in addition to light generated by the light source. Hence, after the step S301, it is possible to detect the light intensity parameters of the N primary colors under the ambient light without turning on the light source, as light intensity parameter interference values of the N primary colors. For example, without turning on the light source of the display device, the light intensity parameter interference values of four primary colors, i.e., red, green, blue and yellow, are measured by the calibrated light sensor, and respectively represented by $R_0$, $G_0$, $B_0$, and $Y_0$. Preferably, for each primary color, several measurements may be performed, and the average value is used as the final light intensity parameter interference value. In the following measurements, it is necessary to subtract the interference value from each measured light intensity parameter value to eliminate the influence of the ambient light, or, if there is large environmental change, before every measurement, an interference value may be measured.

S302: A present light intensity parameter value of each of N primary colors of light emitted by a light source of a display device is acquired.

Optionally, at the present moment, a light intensity parameter of each of the N primary colors may be measured by the light sensor, and then the light intensity parameter interference value of the primary color is respectively subtracted from the measured light intensity parameter value to obtain the present light intensity parameter value of the primary color. For example, the light intensity parameters of the four primary colors, i.e., red, green, blue, yellow, are respectively $R_2$, $G_2$, $B_2$, $Y_2$, the present light intensity parameter values of the four primary colors are respectively $R_c=R_2-R_0$, $G_c=G_2-G_0$, $B_c=B_2-B_0$, $Y_c=Y_2-Y_0$, where $R_c$, $G_c$, $B_c$, $Y_c$ are respectively the present light intensity parameter values of the four primary colors, i.e., red, green, blue, yellow.

S303: A set light intensity parameter value of each of the N primary colors is determined, according to the present light intensity parameter value of each of the N primary colors and the pre-saved light intensity parameter value of each of the N primary colors.

Wherein, a pre-saved light intensity parameter value of a $n^{th}$ primary color of the N primary colors is indicative of the pre-saved light intensity of the $n^{th}$ primary color of the N primary colors of the display device. Generally, the pre-saved light intensity parameter values of the N primary colors are the maximum light intensity the N primary colors can actually achieve when the display device leaves the factory. However, in some cases, the pre-saved light intensity parameter values of the N primary colors are not the maximum light intensity the N primary colors can actually achieve.

Optionally, a standard ratio is determined according to the present light intensity parameter value of each of the N primary colors and the pre-saved light intensity parameter value of each of the N primary colors, the standard ratio being indicative of an adjustment degree of the N primary colors; and the set light intensity parameter value of the $n^{th}$ primary color of the N primary colors is calculated by a first formula $X_{nd}=X_{np}\times U$, where $X_{nd}$ is the set light intensity parameter value of the $n^{th}$ primary color, $X_{np}$ is the pre-saved light intensity parameter value of the $n^{th}$ primary color, and U is the standard ratio.

Further optionally, in this embodiment, if the $i^{th}$ primary color of the N primary colors has a maximum difference between its pre-saved light intensity parameter value and its present light intensity parameter value, the present light intensity parameter value of the $i^{th}$ primary color is used as the standard light intensity parameter value of the $i^{th}$ primary color, i being an integer within [1, N]; and the standard ratio U is calculated by a third formula $U=X_{id}/X_{ip}$, where $X_{id}$ is the standard light intensity parameter value of the $i^{th}$ primary color, and $X_{ip}$ is the pre-saved light intensity parameter value of the $i^{th}$ primary color.

It is to be noted that, the way of calculating a standard ratio and determining the set light intensity parameter value of each primary color according to the standard ratio as described in this embodiment is merely one specific implementation, and there may be many other modifications and other ways. The specific way of determining the set light intensity parameter value of each primary color is not limited in the present disclosure.

Preferably, this embodiment also provides a specific way of determining the set light intensity parameter value of each primary color. Taking four primary colors, i.e., red, green, blue, yellow, as example, and in combination with the step S302, the proportions of the four primary colors in the total brightness of the light source are respectively calculated: $Q_R=R_P/T_P$, $Q_B=B_P/T_P$, $Q_G=G_P/T_P$, $Q_Y=Y_P/T_P$, where $T_P$ is the sum of pre-saved light intensity parameter values of the four primary colors, i.e., $T_p=R_p+G_p+B_p+Y_p$, $Q_R$, $Q_B$, $Q_G$, $Q_Y$ are respectively the proportions of the four primary colors, i.e., the percentages of the four primary colors in the total brightness of the light source.

The attenuation degrees of the four primary colors are respectively calculated: $R'=(R_p-R_c)/R_p$, $G'=(G_p-G_c)/G_p$, $B'=(B_p-B_c)/B_p$, $Y'=(Y_p-Y_c)/Y_p$, to determine a primary color having a maximum attenuation degree. Taking red light having a maximum attenuation degree as an example, the present light intensity parameter value of the red light may be regarded as the set light intensity parameter value of the red light; the sum of the set light intensity parameter values of the four primary colors may be calculated according to the proportion of the red light, that is, after the attenuation, when the color temperature is normal, the total brightness of the light source should be $T_d=R_c/Q_R$; and the set light intensity parameter values of the other three primary colors are respectively calculated according to the proportion of each primary color, that is, while maintaining normal color temperature, the percentage of each primary color in the total brightness of the light source should be the same as the original percentage: $G_d=T_d\times Q_G$, $B_d=T_d\times Q_B$, $Y_d=T_d\times Q_Y$, $G_d$, $B_d$, $Y_d$ being the set light intensity parameter values of the other three primary colors, i.e., green, blue, yellow. Of course, this is provided as an example, and the present disclosure is not limited thereto. It is to be noted that, during the above calculation, if reduction of a fraction is performed, the calculation formula is substantially the same as the first formula. Green light is taken as an example:

$$\begin{aligned} G_d &= T_d \times Q_G = (R_c / Q_R) \times Q_G \\ &= R_c \times \frac{T_p}{R_p} \times \frac{G_p}{T_p} = \frac{R_c}{R_p} \times G_p \\ &= U \times G_p \end{aligned}$$

S304: The light intensity of each of the N primary colors respectively is adjusted according to the set light intensity parameter value of the N primary colors.

Optionally, the PWM value of each of the N primary color may be respectively adjusted according to the set light intensity parameter value of the N primary colors. The PWM value of the $n^{th}$ primary color of the N primary colors is indicative of the magnitude of current of the $n^{th}$ primary color.

Further optionally, a variation $\Delta P_n$ in the PWM value of the $n^{th}$ primary color of the N primary colors is calculated by a fourth formula $\Delta P_n=(X_{np}-X_{nd})/K_m$, where $X_{nd}$ is the set light intensity parameter value of the $n^{th}$ primary color, $X_{np}$ is the pre-saved light intensity parameter value of the $n^{th}$ primary color, and $K_m$ is an adjustment coefficient which is indicative of a variation in the light intensity parameter of the $n^{th}$ primary color when the PWM value of the $n^{th}$ primary color is increased by 1.

It is to be noted here that, optionally, the corresponding change between the PWM value and the light intensity parameter may not be a constant value. Hence, the light intensity parameter of each primary color may be divided into M segments, M being an integer greater than 1. The corresponding change between the PWM value and the light intensity parameter is different from segment to segment. $K_m$ may be the variation of the light intensity parameter of the primary color when the PWM value of the primary color is increased by 1, when the light intensity parameter of the primary color is within the $m^{th}$ segment. Taking green light as an example, the first segment of the light intensity parameter of the green light is $[G_p, G_{d1})$, second segment is $[G_{d1}, G_{d2})$, . . . , the $m^{th}$ segment is $[G_{dm-1}, G_{dm})$. If the set light intensity parameter value of the green light is within the $m^{th}$ segment of the light intensity parameter segments, the variation of the PWM value of the green light is:

$$\Delta P_n=(G_p-G_{d1})/K_1+(G_{d1}-G_{d2})/K_2 \ldots +(G_{dm-1}-G_{dm})/K_m$$

This is applicable to other primary colors. In this way, the light intensity of each primary color can be adjusted more accurately by segmenting the light intensity parameter according to the change relation between the PWM value and the light intensity parameter and using a different adjustment coefficient for each segment. Of course, this is provided as a specific implementation, and the present disclosure is not limited thereto.

By the method for adjusting color temperature provided by the embodiments of the present disclosure, a present light intensity parameter value of each of N primary colors of light emitted by a light source of a display device is acquired, an attenuation degree of the set light intensity parameter value of each of the N primary colors is determined according to the present light intensity parameter value of each of the N primary colors and a pre-saved light intensity parameter value of each of the N primary colors, the present light intensity parameter value of a primary color having a maximum attenuation degree is used as the set light intensity parameter value of the primary color and a standard ratio is calculated, and the light intensity of each of the N primary colors is respectively adjusted according to the set light intensity parameter value of the N primary colors. In this way, by taking the primary color having a maximum attenuation degree as the standard, the attenuation degree of each primary color is allowed to be the same as the primary color having a maximum attenuation degree, so that the light intensity parameter of each primary color can meet the standard ratio, the light intensity of the primary colors is relatively balanced, and the offset in the color temperature is reduced. Accordingly, the deteriorated quality of display of the display device in the prior art, which is because of causing an offset in the color temperature by inconsistent light attenuation of the primary colors, is solved or alleviated.

Figure 4:
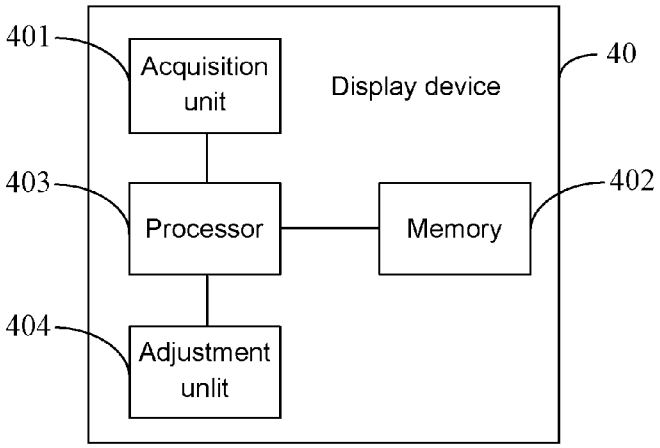
FIG. 4 is a structure diagram of a display device for adjusting color temperature according to one embodiment of the present disclosure.

Based on the embodiments of FIG. 2 and FIG. 3, an embodiment of the present disclosure provides a display device for executing the method for adjusting color temperature as described in the corresponding embodiments of FIG. 2 and FIG. 3. Referring to FIG. 4, the display device includes an acquisition unit 401, a memory 402, a processor 403 and an adjustment unit 404.

Wherein, the acquisition unit 401 is configured to acquire a present light intensity parameter value of each of N primary colors of light emitted by a light source of a display device, a present light intensity parameter value of a $n^{th}$ primary color of the N primary colors being indicative of the present light intensity of the $n^{th}$ primary color of light emitted by the light source of the display device, N being an integer greater than or equal to 3, n being an integer within [1, N]. Specifically, for example, the acquisition unit can be a light sensor which is mounted in a light emitting path of the light source of the display device.

the memory 402 is configured to store programs.

The processor 403 is configured to read the programs in the memory, and execute the step of determining a set light intensity parameter value of each of the N primary colors, according to the present light intensity parameter value of each of the N primary colors acquired by the acquisition unit and a pre-saved light intensity parameter value of each of the N primary colors, wherein a pre-saved light intensity parameter value of a $n^{th}$ primary color of the N primary colors is indicative of the pre-saved light intensity of the $n^{th}$ primary color of the N primary colors of the display device.

The adjustment unit 404 is configured to respectively adjust the light intensity of each of the N primary colors according to the set light intensity parameter value of the N primary colors determinated by the calculation unit 403.

Optionally, in a first application scenario, the processor 403 is further configured to determine a standard ratio according to the present light intensity parameter value of each of the N primary colors and the pre-saved light intensity parameter value of each of the N primary colors, the standard ratio being indicative of an adjustment degree of the N primary colors; and calculate the set light intensity parameter value of the $n^{th}$ primary color of the N primary colors by a first formula $X_{nd}=X_{np}\times U$, where $X_{nd}$ is the set light intensity parameter value of the $n^{th}$ primary color, $X_{np}$ is the pre-saved light intensity parameter value of the $n^{th}$ primary color, and U is the standard ratio.

Further optionally, the processor 403 is further configured to execute the steps of calculating an attenuation degree of the $n^{th}$ primary color of the N primary colors according to a second formula $X'_n=(X_{np}-X_{nc})/X_{np}$, where $X_{np}$ is the pre-saved light intensity parameter value of the $n^{th}$ primary color, $X_n$, is the present light intensity parameter value of the $n^{th}$ primary color, and $X'_n$ is the attenuation degree of the $n^{th}$ primary color; and determining the standard ratio U within an interval $[X_{n1c}/X_{n1p}, X_{n2c}/X_{n2p}]$, where $X_{n1c}$ is a present light intensity parameter value of a primary color having a minimum attenuation degree, $X_{n1p}$ is a pre-saved light intensity parameter value of a primary color having a minimum attenuation degree, $X_{n2c}$ is a present light intensity parameter value of a primary color having a maximum attenuation degree, and $X_{n2p}$ is a pre-saved light intensity parameter value of a primary color having a maximum attenuation degree.

Optionally, the processor 403 is further configured to use a present light intensity parameter value of an $i^{th}$ primary color as a standard light intensity parameter value of the $i^{th}$ primary color when the $i^{th}$ primary color has a maximum difference between its maximum light intensity parameter value and its present light intensity parameter value, i being an integer within [1, N]; and calculate the standard ratio U by a third formula $U=X_{id}/X_{ip}$, where $X_{id}$ is the standard light intensity parameter value of the $i^{th}$ primary color, and $X_{ip}$ is the pre-saved light intensity parameter value of the $i^{th}$ primary color.

Optionally, in a second application scenario, in the display device, the pre-saved light intensity parameter value of each of the N primary colors is equal to the maximum light intensity the primary color can actually achieve, and the adjustment unit 404 is further configured to: for a primary color having a present light intensity parameter value greater than its set light intensity parameter value, reduce the light intensity of the primary color to the set light intensity parameter value of the primary color; and for a primary color having a present light intensity parameter value less than its set light intensity parameter value, maintain the light intensity of the primary color at the present light intensity parameter value of the primary color; and in the display device, the pre-saved light intensity parameter value of each of the N primary colors is less than the maximum light intensity the primary color can actually achieve, and the adjustment unit 404 is further configured to: for a primary color having a present light intensity parameter value greater than its set light intensity parameter value, reduce the light intensity of the primary color; and for a primary color having a present light intensity parameter value less than its set light intensity parameter value, increase the light intensity of the primary color.

Further, the adjustment unit 404 is further configured to: for a primary color having a present light intensity parameter value greater than its set light intensity parameter value, reduce the light intensity of the primary color to the set light intensity parameter value of the primary color; and for a primary color having a present light intensity parameter value less than its set light intensity parameter value, increase the light intensity of the primary color to the set light intensity parameter value of the primary color if a driving signal which drives the primary color to reach the maximum light intensity the primary color can actually reach is greater than a driving signal which drives the primary color to reach the set light intensity parameter value thereof, and increase the light intensity of the primary color to the maximum light intensity the primary color can actually reach if a driving signal which drives the primary color to reach the maximum light intensity the primary color can actually reach is less than a driving signal which drives the primary color to reach the set light intensity parameter value thereof.

Further, the adjustment unit 404 is further specifically configured to respectively adjust the PWM value of each of the N primary color according to the set light intensity parameter value of the N primary colors, the PWM value of the $n^{th}$ primary color of the N primary colors being indicative of the magnitude of current of the $n^{th}$ primary color.

Further optionally, the adjustment unit 404 is further configured to calculate a variation $\Delta P_n$ in the PWM value of the $n^{th}$ primary color of the N primary colors by a fourth formula $\Delta P_n=(X_{np}-X_{nd})/K_m$, where $X_{nd}$ is the set light intensity parameter value of the $n^{th}$ primary color, $X_{np}$ is the pre-saved light intensity parameter value of the $n^{th}$ primary color, and $K_m$ is an adjustment coefficient which is indicative of a variation in the light intensity parameter of the $n^{th}$ primary color when the PWM value of the $n^{th}$ primary color is increased by 1.

Optionally, in a third application scenario,

When the pre-saved light intensity parameter value of each of the N primary colors is less than the maximum light intensity the primary color can actually achieve, the processor 403 is further configured to determine the pre-saved light intensity parameter value of each of the N primary colors as the set light intensity parameter value of each of the N primary colors.

Correspondingly, the adjustment unit 404 is further configured to adjust the light intensity of the N primary colors to Y % of the set light intensity parameter value of each of the N primary colors, wherein Y % of the set light intensity parameter value of each of the N primary colors is greater than the present light intensity parameter value of each of the N primary colors.

By the display device provided by the embodiments of the present disclosure, a present light intensity parameter value of each of N primary colors of light emitted by a light source of a display device is acquired, a set light intensity parameter value of each of the N primary colors is determined according to the present light intensity parameter value of each of the N primary colors and a pre-saved light intensity parameter value of each of the N primary colors, and the light intensity of each of the N primary colors is adjusted according to the set light intensity parameter value of the N primary colors. In this way, the set light intensity parameter value of each primary color is determined and adjusted, respectively, so that the light intensity of the primary colors is relatively balanced, and the offset in the color temperature is reduced. Accordingly, the deteriorated quality of display of the display device in the prior art, which is because of causing an offset in the color temperature by inconsistent light attenuation of the primary colors, is solved or alleviated.

In the embodiments provided in the application, it should be understood that the disclosed system, device and method may be implemented in other ways. For example, the device embodiments described above are merely exemplary. For example, the division of the units is merely division of logical functions. There may be other division ways when in practical implementation, for example, many units or components may be combined together or may be integrated into another system, or some features may be omitted or not executed. In addition, the coupling or direct coupling or communicative connection between the shown or discussed devices or units may be achieved by some interfaces, and the indirect coupling or communicative connection between the devices or units may be in electric, mechanical or other forms.

The units described as separated components may or may not be separated physically. Components, serving as display units, may or may not be physical units, that is, they may be located in one place or distributed over a plurality of network units. Some or all of the units may be selected to implement the purpose of the solution of the embodiment, as desired.

In addition, the functional units in the embodiments of the present disclosure may be integrated in one processing unit; the functional units may be physically included in a unit alone; or two or more functional units may be integrated in one unit. The integrated units may be implemented in a hardware form, or may be implemented in combination of hardware and software functional units.

The integrated units implemented in a form of software functional units may be stored in a computer-readable storage medium. The software functional units are stored in a storage medium containing a number of instructions which enable a computer apparatus (this computer apparatus may be a personal computer, a server or a network apparatus or the like) to execute some of steps of the method according to the embodiments of the present disclosure. The storage medium includes a USB flash disk, a removable disk, a read-only memory (ROM), a random access memory (RAM), a magnetic disk, an optical disk, and various media which can store program codes therein.

Finally, it is to be noted that the above embodiments are merely used for describing the technical solutions of the present disclosure, not for limiting the present disclosure. Although the present disclosure has been described in detail with reference to the above embodiments, it should be understood by a person of ordinary skill in the art that modifications may be made to the technical solutions recorded in the above embodiments or equivalent replacements may be made to some of the technical features in the above embodiments, and those modifications or replacements shall not make the essence of the corresponding technical solutions depart from the spirit and scope of the technical solutions of the embodiments of the present disclosure.

What is claimed is:

1. A display device, comprising:

an acquisition unit, configured to acquire a present light intensity parameter value of each of N primary colors of light emitted by a light source of a display device, a present light intensity parameter value of a nth primary color of the N primary colors being indicative of the present light intensity of the nth primary color of light emitted by the light source of the display device, N being an integer greater than or equal to 3, n being an integer within [1, N];

a memory, configured to store programs;

a processor, configured to read the programs in the memory, and execute the step of determining a set light intensity parameter value of each of the N primary colors, according to the present light intensity parameter value of each of the N primary colors acquired by the acquisition unit and a pre-saved light intensity parameter value of each of the N primary colors, and execute the step of calculating the set light intensity parameter value of the $n^{th}$ primary color of the N primary colors by a first formula $X_{nd}=X_{np}\times U$, where $X_{nd}$ is the set light intensity parameter value of the $n^{th}$ primary color, $X_{np}$ is the pre-saved light intensity parameter value of the $n^{th}$ primary color, and U is the standard ratio; and an adjustment unit, configured to respectively adjust the light intensity of each of the N primary colors according to the set light intensity parameter value of the N primary colors determined by the processor.

2. The device according to claim 1, wherein the processor is further configured to execute the steps of determining an attenuation degree of the $n^{th}$ primary color of the N primary colors according to a second formula $X'_n=(X_{np}-X_{nc})/X_{np}$, where $X_{np}$ is the pre-saved light intensity parameter value of the $n^{th}$ primary color, $X_{nc}$ is the present light intensity parameter value of the $n^{th}$ primary color, and $X'_n$ is the attenuation degree of the $n^{th}$ primary color; and determining the standard ratio U within an interval $[X_{n1c}/X_{n1p}, X_{n2c}/X_{n2p}]$, where $X_{n1c}$ is a present light intensity parameter value of a primary color having a minimum attenuation degree, $X_{n1p}$ is a pre-saved light intensity parameter value of a primary color having a minimum attenuation degree, $X_{n2c}$ is a present light intensity parameter value of a primary color having a maximum attenuation degree, and $X_{n2p}$ is a pre-saved light intensity parameter value of a primary color having a maximum attenuation degree.

3. The device according to claim 2, wherein the pre-saved light intensity parameter value of each of the N primary colors is equal to the maximum light intensity each primary color can actually achieve; and the adjustment unit is further configured to: for a primary color having a present light intensity parameter value greater than its set light intensity parameter value, reduce the light intensity of the primary color to the set light intensity parameter value of the primary color; and for a primary color having a present light intensity parameter value less than its set light intensity parameter value, maintain the light intensity of the primary color at the present light intensity parameter value of the primary color.

4. The device according to claim 2, wherein the processor is further configured to execute the steps of using a present light intensity parameter value of an $i^{th}$ primary color, having a maximum attenuation degree, of the N primary colors as a standard light intensity parameter value of the $i^{th}$ primary color, i being an integer within [1, N]; and calculating the standard ratio U by a third formula $U=X_{id}/X_{ip}$, where $X_{id}$ is the standard light intensity parameter value of the $i^{th}$ primary color, and $X_{ip}$ is the pre-saved light intensity parameter value of the $i^{th}$ primary color.

5. The device according to claim 2, wherein the pre-saved light intensity parameter value of each of the N primary colors is less than the maximum light intensity each primary color can actually achieve; and the adjustment unit is further configured to: for a primary color having a present light intensity parameter value greater than its set light intensity parameter value, reduce the light intensity of the primary color; and for a primary color having a present light intensity parameter value less than its set light intensity parameter value, increase the light intensity of the primary color.

6. The device according to claim 5, wherein the adjustment unit is further configured to: for a primary color having a present light intensity parameter value greater than its set light intensity parameter value, reduce the light intensity of the primary color to the set light intensity parameter value of the primary color; and for a primary color having a present light intensity parameter value less than its set light intensity parameter value, increase the light intensity of the primary color to the set light intensity parameter value of the primary color if a driving signal which drives the primary color to reach the maximum light intensity the primary color can actually achieve is greater than a driving signal which drives the primary color to reach the set light intensity parameter value thereof, and increase the light intensity of the primary color to the maximum light intensity the primary color can actually achieve if a driving signal which drives the primary color to reach the maximum light intensity the primary color can actually achieve is less than a driving signal which drives the primary color to reach the set light intensity parameter value thereof.

7. A display device, comprising:

an acquisition unit, configured to acquire a present light intensity parameter value of each of N primary colors of light emitted by a light source of a display device, a present light intensity parameter value of a nth primary color of the N primary colors being indicative of the present light intensity of the nth primary color of light emitted by the light source of the display device, N being an integer greater than or equal to 3, n being an integer within [1, N];

a memory, configured to store programs;

a processor, configured to read the programs in the memory, and execute the step of determining a set light intensity parameter value of each of the N primary colors, according to the present light intensity parameter value of each of the N primary colors acquired by the acquisition unit and a pre-saved light intensity parameter value of each of the N primary colors; and an adjustment unit, configured to calculate a variation $\Delta P_n$ in a pulse width modulation (PWM) value of the $n^{th}$ primary color of the N primary colors by a fourth formula $\Delta P_n=(X_{np}-X_{nd})/K_m$, where $X_{nd}$ is the set light intensity parameter value of the $n^{th}$ primary color, $X_{np}$ is the pre-saved light intensity parameter value of the $n^{th}$ primary color, and $K_m$ is an adjustment coefficient which is indicative of a variation in the light intensity parameter of the $n^{th}$ primary color when the PWM value of the $n^{th}$ primary color is increased by 1, and respectively to adjust the PWM value of the $n^{th}$ primary color of the N primary colors according to the variation $\Delta P_n$, wherein the PWM value of the it mare color of the N primary colors being indicative of the magnitude of present controlling the light intensity of the nth primary color.

8. A display device, comprising:

an acquisition unit, configured to acquire a present light intensity parameter value of each of N primary colors of light emitted by a light source of a display device, a present light intensity parameter value of a nth primary color of the N primary colors being indicative of the present light intensity of the nth primary color of light emitted by the light source of the display device, N being an integer greater than or equal to 3, n being an integer within [1, N];

a memory, configured to store programs;

a processor, configured to read the programs in the memory, and execute the step of determining a pre-saved light intensity parameter value of each of the N primary colors as a set light intensity parameter value of each of the N primary colors in a case in which the pre-saved light intensity parameter value of each of the N primary colors is less than a maximum light intensity each primary color can actually achieve; and an adjustment unit, configured to adjust the light intensity of the N primary colors to Y % of the pre-saved light intensity parameter value of each of the N primary colors, wherein Y % of the pre-saved light intensity parameter value of each of the N primary colors is greater than the present light intensity parameter value of each of the N primary colors.

9. A method for adjusting color temperature, comprising:

acquiring, by an acquisition unit, a present light intensity parameter value of each of N primary colors of light emitted by a light source of a display device, a present light intensity parameter value of a nth primary color of the N primary colors being indicative of the present light intensity of the nth primary color of light emitted by the light source of the display device, N being an integer greater than or equal to 3, n being an integer within [1, N];

determining, by a processor, a standard ratio according to the present light intensity parameter value of each of the N primary colors and a pre-saved light intensity parameter value of each of the N primary colors, the standard ratio being indicative of an adjustment degree of the N primary colors;

calculating, by the processor, a set light intensity parameter value of the $n^{th}$ primary color of the N primary colors by a first formula $X_{nd}=X_{np}\times U$, where $X_{nd}$ is the set light intensity parameter value of the $n^{th}$ primary color, $X_{np}$ is a pre-saved light intensity parameter value of the $n^{th}$ primary color, and U is the standard ratio; and respectively adjusting, by an adjustment unit, the light intensity of each of the N primary colors according to the set light intensity parameter value of the N primary colors.

10. The method according to claim 9, wherein the determining, by a processor, a standard ratio according to the present light intensity parameter value of each of the N primary colors and the pre-saved light intensity parameter value of each of the N primary colors, comprises:

determining, by the processor, an attenuation degree of the $n^{th}$ primary color of the N primary colors according to a second formula $X'_n=(X_{np}-X_{nc})/X_{np}$, where $X_{np}$ is the pre-saved light intensity parameter value of the $n^{th}$ primary color, $X_{nc}$ is the present light intensity parameter value of the $n^{th}$ primary color, and $X'_n$ is the attenuation degree of the $n^{th}$ primary color; and determining, by the processor, the standard ratio U within an interval $[X_{n1c}/X_{n1p}, X_{n2c}/X_{n2p}]$, where $X_{n1c}$ is a present light intensity parameter value of a primary color having a minimum attenuation degree, $X_{n1p}$ is a pre-saved light intensity parameter value of a primary color having a minimum attenuation degree, $X_{n2c}$ is a present light intensity parameter value of a primary color having a maximum attenuation degree, and $X_{n2p}$ is a pre-saved light intensity parameter value of a primary color having a maximum attenuation degree.

11. The method according to claim 10, wherein the pre-saved light intensity parameter value of each of the N primary colors is equal to the maximum light intensity each primary color can actually achieve; and the respectively adjusting, by an adjustment unit, the light intensity of each of the N primary colors according to the set light intensity parameter value of the N primary colors, comprises:

for a primary color having a present light intensity parameter value greater than its set light intensity parameter value, reducing, by the adjustment unit, the light intensity of the primary color to the set light intensity parameter value of the primary color; and for a primary color having a present light intensity parameter value less than its set light intensity parameter value, maintaining, by the adjustment unit, the light intensity of the primary color at the present light intensity parameter value of the primary color.

12. The method according to claim 10, wherein the determining, by the processor, the standard ratio U within an interval $[X_{n1c}/X_{n1p}, X_{n2c}/X_{n2p}]$, comprises:

using, by the processor, a present light intensity parameter value of an $i^{th}$ primary color, having a maximum attenuation degree, of the N primary colors as a standard light intensity parameter value of the $i^{th}$ primary color, i being an integer within [1, N]; and calculating, by the processor, the standard ratio U by a third formula $U=X_{id}/X_{ip}$, where $X_{id}$ is the standard light intensity parameter value of the $i^{th}$ primary color, and $X_{ip}$ is the pre-saved light intensity parameter value of the $i^{th}$ primary color.

13. The method according to claim 10, wherein the pre-saved light intensity parameter value of each of the N primary colors is less than the maximum light intensity each primary color can actually achieve; and the respectively adjusting, by an adjustment unit, the light intensity of each of the N primary colors according to the set light intensity parameter value of the N primary colors, comprises:

for a primary color having a present light intensity parameter value greater than its set light intensity parameter value, reducing, by the adjustment unit, the light intensity of the primary color; and for a primary color having a present light intensity parameter value less than its set light intensity parameter value, increasing, by the adjustment unit, the light intensity of the primary color.

14. The method according to claim 13, wherein the reducing, by the adjustment unit, for a primary color having a present light intensity parameter value greater than its set light intensity parameter value, the light intensity of the primary color, comprises: for a primary color having a present light intensity parameter value greater than its set light intensity parameter value, reducing, by the adjustment unit, the light intensity of the primary color to the set light intensity parameter value of the primary color; and the increasing, by the adjustment unit, for a primary color having a present light intensity parameter value less than its set light intensity parameter value, the light intensity of the primary color, comprises: for a primary color having a present light intensity parameter value less than its set light intensity parameter value, by the adjustment unit, increasing the light intensity of the primary color to the set light intensity parameter value of the primary color if a driving signal which drives the primary color to reach the maximum light intensity the primary color can actually achieve is greater than a driving signal which drives the primary color to reach the set light intensity parameter value thereof, and increasing the light intensity of the primary color to the maximum light intensity the primary color can actually achieve if a driving signal which drives the primary color to reach the maximum light intensity the primary color can actually achieve is less than a driving signal which drives the primary color to reach the set light intensity parameter value thereof.

15. A method for adjusting color temperature, comprising:

acquiring, by an acquisition unit, a present light intensity parameter value of each of N primary colors of light emitted by a light source of a display device, a present light intensity parameter value of a nth primary color of the N primary colors being indicative of the present light intensity of the nth primary color of light emitted by the light source of the display device N being an integer greater than or equal to 3, n being an integer within [1, N];

determining, by a processor, a set light intensity parameter value of each of the N primary colors, according to the present light intensity parameter value of each of the N primary colors and a pre-saved light intensity parameter value of each of the N primary colors; and calculating, by an adjustment unit, a variation $\Delta P_n$ in a pulse width modulation (PWM) value of the $n^{th}$ primary color of the N primary colors by a fourth formula $\Delta P_n=(X_{np}-X_{nd})/K_m$, where $X_{nd}$ is a set light intensity parameter value of the $n^{th}$ primary color, is a pre-saved light intensity parameter value of the $n^{th}$ primary color, and $K_m$ is an adjustment coefficient which is indicative of a variation in a light intensity parameter of the $n^{th}$ primary color when the PWM value of the $n^{th}$ primary color is increased by 1, respectively adjusting, by the adjustment unit, the PWM value of the $n^{th}$ primary color of the N primary colors according to the variation $\Delta P_n$, wherein e PWM value of the nth primary color of the N primary colors being indicative of the magnitude of present controlling the light intensity of the nth primary color.

16. A method for adjusting color temperature, comprising:

acquiring, by an acquisition unit, a present light intensity parameter value of each of N primary colors of light emitted by a light source of a display device, a present light intensity parameter value of a nth primary color of the N primary colors being indicative of the present light intensity of the nth primary color of light emitted by the light source of the display device, N being an integer greater than or equal to 3, n being an integer within [1, N];

reading, by a processor, programs in a memory;

determining, by a processor, a pre-saved light intensity parameter value of each of the N primary colors as a set light intensity parameter value of each of the N primary colors, in a case in which the pre-saved light intensity parameter value of each of the N primary colors is less than a maximum light intensity each primary color can actually achieve; and adjusting, by an adjustment unit, a light intensity of the N primary colors to Y % of the set light intensity parameter value of each of the N primary colors, wherein Y % of the set light intensity parameter value of each of the N primary colors is greater than the present light intensity parameter value of each of the N primary colors.

* * * * *